US010577799B2

(12) United States Patent
Hill

(10) Patent No.: US 10,577,799 B2
(45) **Date of Patent: *Mar. 3, 2020**

(54) INSULATED ROOF DIAPHRAGMS AND METHODS

(71) Applicant: SIKA TECHNOLOGY AG, Barr (CH)

(72) Inventor: Laurie Hill, Allen, TX (US)

(73) Assignee: SIKA TECHNOLOGY AG, Baar (CH)

( * ) Notice: Subject to any disclaimer, the term of this patent is extended or adjusted under 35 U.S.C. 154(b) by 0 days.

This patent is subject to a terminal disclaimer.

(21) Appl. No.: 15/999,544

(22) Filed: Aug. 20, 2018

(65) Prior Publication Data

US 2019/0003180 A1 Jan. 3, 2019

Related U.S. Application Data

(63) Continuation of application No. 15/591,457, filed on May 10, 2017, now Pat. No. 10,094,113.

(60) Provisional application No. 62/335,190, filed on May 12, 2016.

(51) Int. Cl.

| | |
|---|---|
| ***E04C 2/296*** | (2006.01) |
| ***E04D 13/16*** | (2006.01) |
| ***E04B 1/76*** | (2006.01) |
| ***E04B 1/80*** | (2006.01) |
| ***E04B 7/02*** | (2006.01) |
| ***E04B 2/00*** | (2006.01) |
| ***E04D 1/34*** | (2006.01) |

(52) U.S. Cl.

CPC ..... *E04C 2/296* (2013.01); *E04B 1/7629* (2013.01); *E04B 1/80* (2013.01); *E04B 7/022* (2013.01); *E04C 2/44* (2013.01); *E04D 1/34* (2013.01); *E04D 13/1618* (2013.01); *E04B 2103/04* (2013.01)

(58) Field of Classification Search

CPC ... E04C 2/296; E04C 2/44; E04D 1/34; E04B 1/80; E04B 7/022; E04B 2103/04

See application file for complete search history.

(56) References Cited

U.S. PATENT DOCUMENTS 3,121,649 A * 2/1964 Oliver ..... E04D 3/351 156/229
5,433,050 A * 7/1995 Wilson ..... E04D 13/172 52/281

(Continued)

*Primary Examiner* — Patrick J Maestri

(74) *Attorney, Agent, or Firm* — Haynes and Boone, LLP

(57) ABSTRACT

A roof system and related methods for installing the roof system. The roof system includes a roof diaphragm including a nail board and an insulating panel connected to the nail board, wherein the insulating panel is adapted to be positioned between the nail board and a roof frame so that the insulating panel engages the roof frame. In several exemplary embodiments, the nail board comprises one or both of: oriented strand board (OSB) and plywood. In several exemplary embodiments, the insulating panel comprises one or both of: a closed-cell rigid polyisocyanurate (polyiso) foam core and a polystyrene foam core. In several exemplary embodiments, the roof system further includes a plurality of nail board fasteners connecting the roof diaphragm to the roof frame, the nail board fasteners each extending through the nail board, through the insulating panel, and into the roof frame to a depth.

62 Claims, 10 Drawing Sheets

(56) References Cited

U.S. PATENT DOCUMENTS

| | | | | |
|---|---|---|---|---|
| 7,765,756 | B2 * | 8/2010 | Bontrager, II | E04D 11/02<br>428/316.6 |
| 2001/0027629 | A1 * | 10/2001 | Ojala | E04B 1/26<br>52/408 |

* cited by examiner

INSULATED ROOF DIAPHRAGMS AND METHODS

CROSS-REFERENCE TO RELATED APPLICATIONS

This application is a continuation of U.S. application Ser. No. 15/591,457, filed May 10, 2017, which claims the benefit of the filing date of, and priority to, U.S. Application No. 62/335,190, filed May 12, 2016, the entire disclosures of which are hereby incorporated herein by reference.

TECHNICAL FIELD

The present disclosure relates generally to roof diaphragms and, more particularly, to a roof diaphragm for insulating a building structure.

BACKGROUND

During the construction of a building structure, a roof diaphragm is installed over a roof frame, which may include roof structural members such as, for example, rafters, trusses, or the like. The roof diaphragm is made of wood or timber "decking," which is engaged with the roof frame and connected thereto with fasteners. In some cases (e.g., air-conditioned attics, vaulted ceilings, etc.), insulation is needed to increase the thermal resistance value (R-value) of the roof, which insulation may be provided by installing insulation panels on top of the roof diaphragm, requiring substantial labor and materials.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
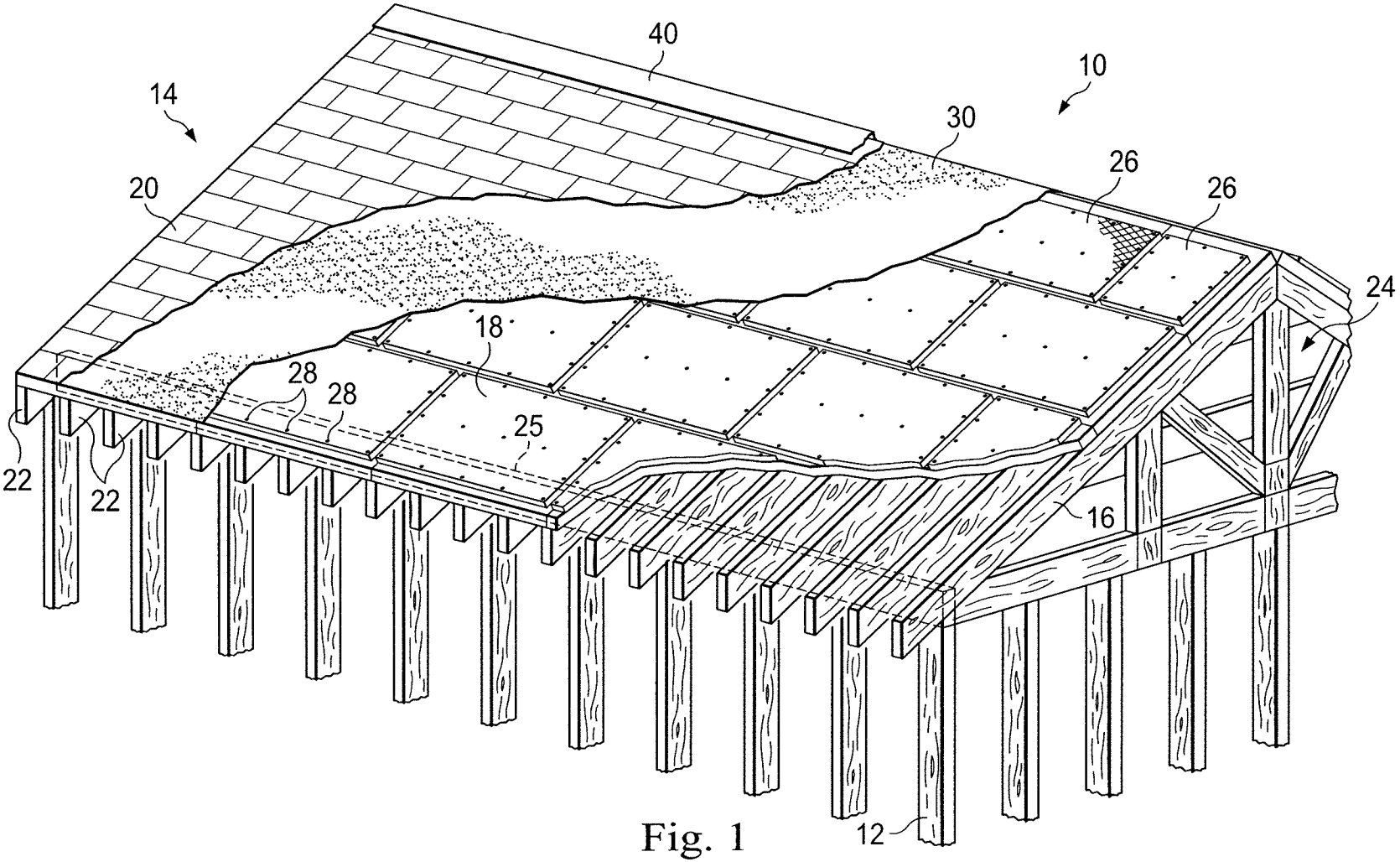
FIG. 1 is a perspective view of a building structure, according to an exemplary embodiment, the building structure including a wall system and a roof system, the roof system including a roof frame, a roof diaphragm, and a roof cover.

Referring to FIG. 1, an exemplary embodiment of a building structure is generally referred to by the reference numeral 10 and includes a wall system 12 and a roof system 14. The roof system 14 is supported by the wall system 12 and includes a roof frame 16, a roof diaphragm 18, and a roof cover 20. The roof frame 16 includes a plurality of roof structural members 22, which at least partially define an attic space 24. The roof structural members 22 may be, include, or be part of rafters, ceiling joists, collars, hangers, struts, purlins, fasciae, ridge boards, solid blocking members, and/or the like. Wall plates 25 are positioned at the top of the wall system 12 to support the roof structural members 22. In an exemplary embodiment, the wall plates 25 are part of the roof frame 16. In several exemplary embodiments, the building structure 10 is a residential building structure.

The roof diaphragm 18 includes a plurality of sheathing panels 26 connected to the roof structural members 22 via a plurality of nail board fasteners 28, thus further defining, and enclosing, the attic space 24. As a result, the roof diaphragm 18 reinforces the building structure 10 by resisting combined lateral (shear) loads and gravity loads created by, for example, seismic shocks, wind lift, and/or other forces. The roof cover 20 includes shingles, tiles, metal roofing materials, and/or the like installed over the roof diaphragm 18 to at least partially weatherproof the building structure 10. Additionally, a protective layer of sheeting 30 (e.g., roofing felt) is installed beneath the roof cover 20. In several exemplary embodiments, the sheeting 30 is part of the roof cover 20.

Figure 2:
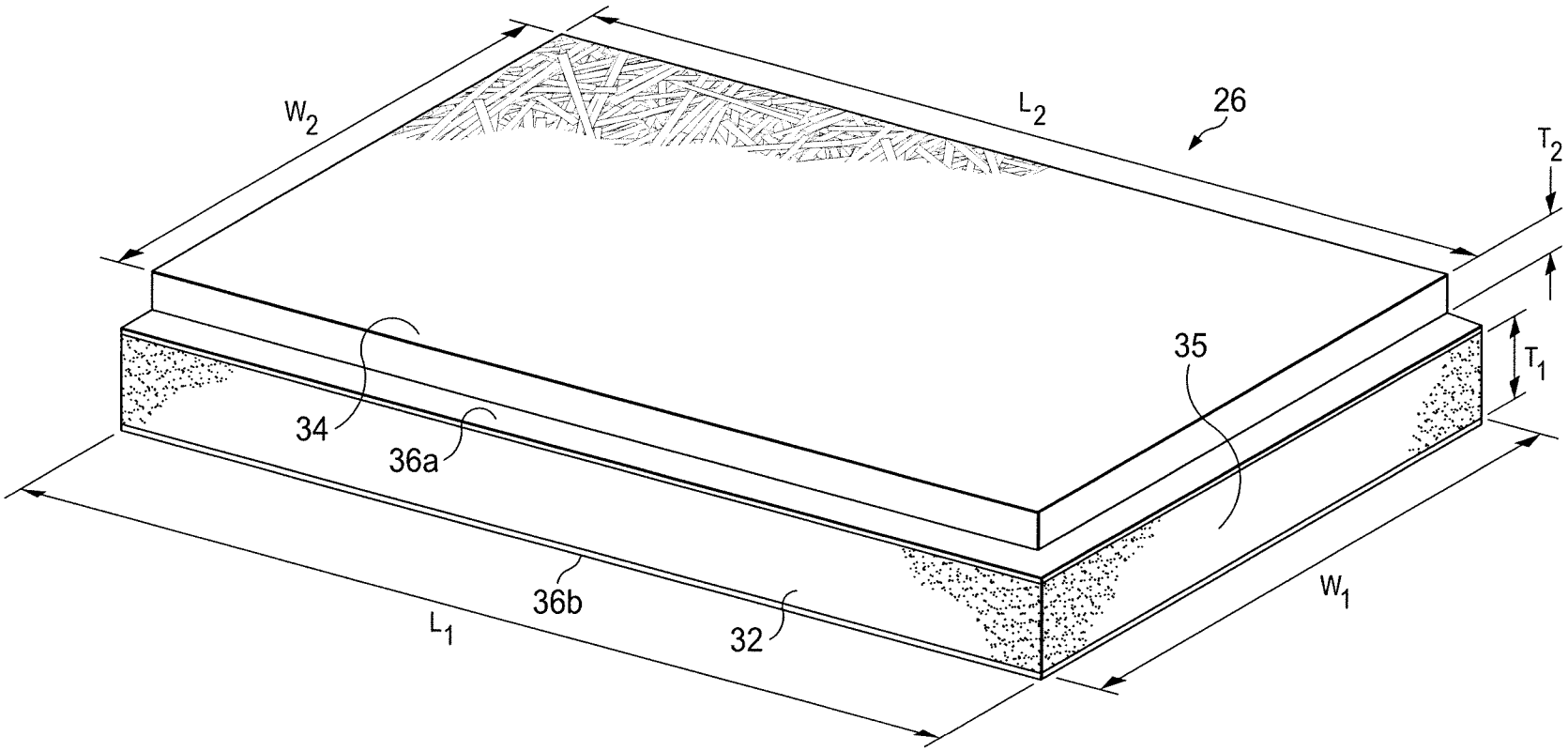
FIG. 2 is a perspective view of a sheathing panel of the roof diaphragm of FIG. 1, according to an exemplary embodiment.

Referring now to FIG. 2, with continuing reference to FIG. 1, the sheathing panels 26 of the roof diaphragm 18 are identical to each other and, therefore, in connection with FIG. 2, only one of the sheathing panels 26 will be described in detail below. Thus, in an exemplary embodiment, as shown in FIG. 2, the sheathing panel 26 is an insulated sheathing product including an insulating panel 32 and a nail board 34. The insulating panel 32 is connected to the nail board 34. In several exemplary embodiments, the insulating panel 32 is connected to the nail board 34 by being bonded to the nail board 34; in several exemplary embodiments, glue and/or another adhesive bonds the insulating panel 32 to the nail board 34. In several exemplary embodiments, the insulating panel 32 is connected to the nail board 34 with fasteners such as, for example, staples. In several exemplary embodiments, each of the sheathing panels 26 is, includes, or is part of, the roof diaphragm 18 or a section thereof.

The insulating panel 32 defines a thickness $T_1$, a length $L_1$, and a width $W_1$. The insulating panel 32 includes a closed-cell rigid polyisocyanurate ("polyiso") foam core 35 and facers **36*a* and 36*b*. The facer 36*a* covers the side of the foam core 35 proximate the nail board 34, and the facer 36*b* covers the side of the foam core 35 opposite the nail board 34. As a result, the facer 36*b* is adapted to be exposed to the attic space 24, as will be discussed in detail below. In an exemplary embodiment, the facers 36*a* and 36*b* are bonded to the respective opposing sides of the foam core 35 without the use of glue or other adhesives. In several exemplary embodiments, the insulating panel 32** is manufactured in accordance with ASTM C1289 (*Standard Specification for Faced Rigid Cellular Polyisocyanurate Thermal Insulation Board*). In several exemplary embodiments, the insulating panel 32 is Rmax® TSX-8500 thermal insulation board.

In an exemplary embodiment, the foam core 35 includes Class A polyiso, which meets a flame spread requirement of equal to or less than 25, per ASTM E84 (*Standard Test Method for Surface Burning Characteristics of Building Materials*), and is approved for use without a thermal barrier or an ignition barrier, per the applicable Sections of the *International Building Code* (the "IBC") and the *International Residential Code* (the "IRC"). Alternatively, the foam core 35 may include Class B or Class C polyiso. In several exemplary embodiments, the foam core 35 is another foam plastic material such as, for example, extruded or expanded polystyrene. However, the foam core 35 may include another material such as, for example, a rigid foam or spray foam, another foam plastic material, mineral wool/fiber, phenolic, or the like.

Figure 8:
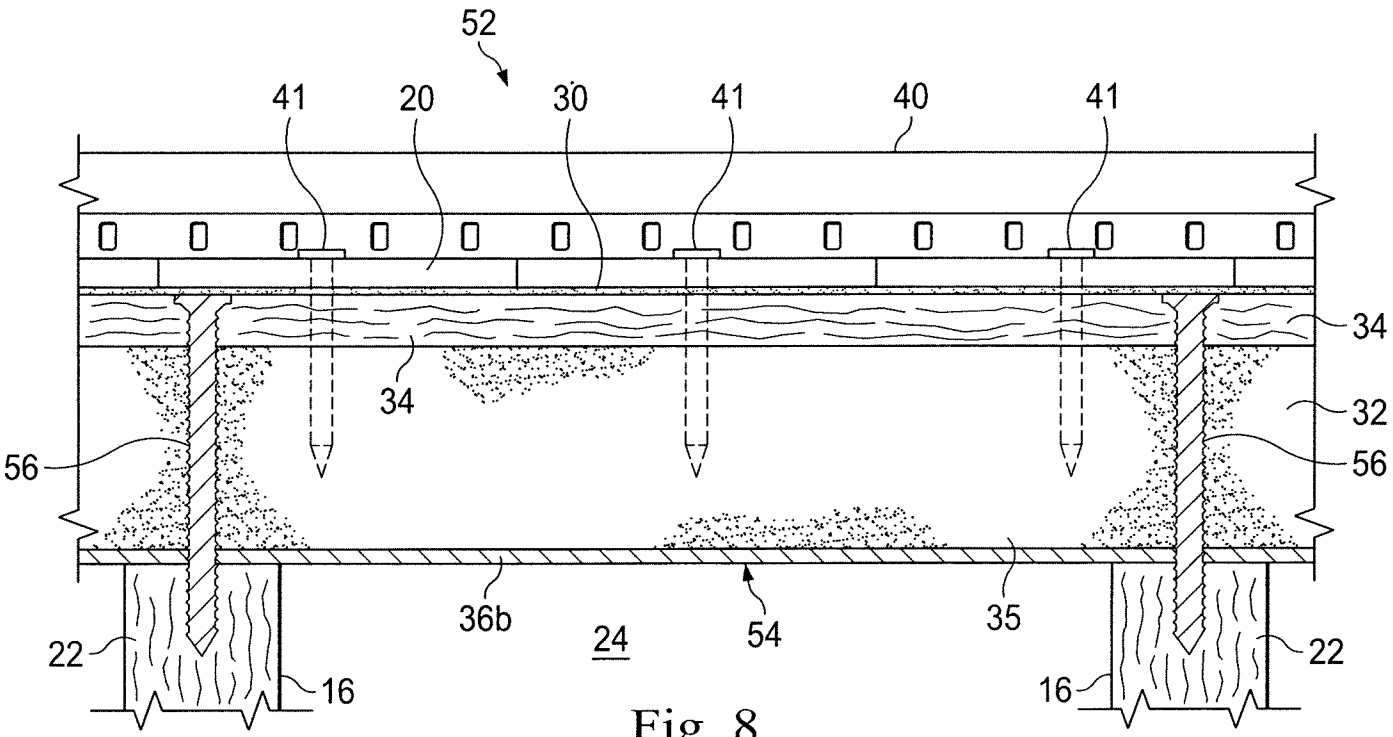
FIG. 8 is a section view of another roof system in an assembled condition, according to an exemplary embodiment.
Figure 9:
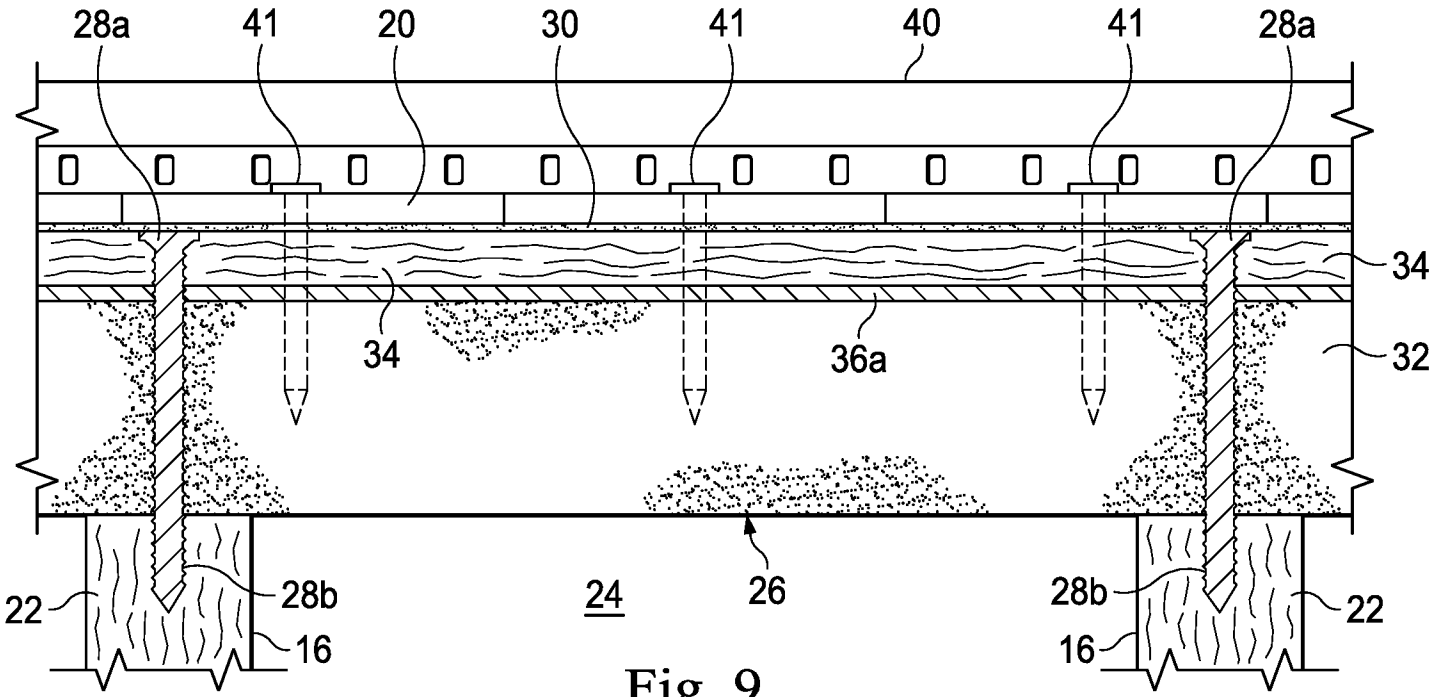
FIG. 9 is a section view of yet another roof system in an assembled condition, according to an exemplary embodiment.
Figure 10:
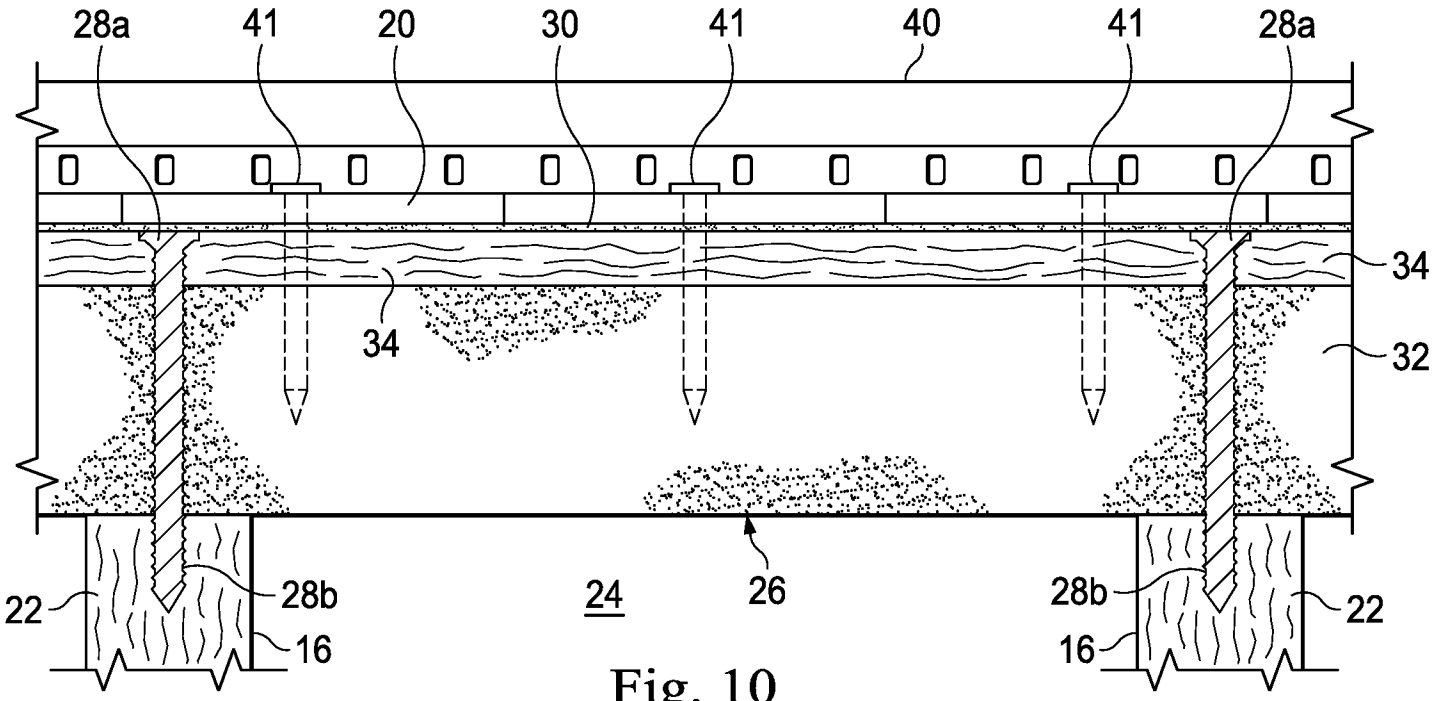
FIG. 10 is a section view of yet another roof system in an assembled condition, according to an exemplary embodiment.

In an exemplary embodiment, the facers 36*a* and 36*b* are glass fiber reinforced aluminum foil facers. The facer 36*b* is exposed and, for that reason, defines a heavy 12 mil thickness. Alternatively, one or both of the facers 36*a* and 36*b* may define another thickness of glass fiber reinforced aluminum. In several exemplary embodiments, at least one of the facers 36*a* and 36*b* includes an aluminum reflective surface. In several exemplary embodiments, at least one of the facers 36*a* and 36*b* is adapted to act as a radiant barrier. In several exemplary embodiments, at least one of the facers 36*a* and 36*b* is a glass fiber/organic mat facer. In several exemplary embodiments, at least one of the facers 36*a* and 36*b* is an inorganic polymer coated glass fiber mat facer. In several exemplary embodiments, at least one of the facers 36*a* and 36*b* includes hard temper foil, 2-ply laminate (foil/kraft), trilaminate (foil/kraft/foil or foil/kraft/PET), and/or coated glass mat. In several exemplary embodiments, at least one of the facers 36*a* and 36*b* includes a single layer of pure PET. In several exemplary embodiments, the facers 36*a* and 36*b* are part of the insulating panel 32. In several exemplary embodiments, the facers 36*a* and 36*b* are omitted and the insulating panel 32 does not include the facers 36*a* and 36*b* , as shown in FIG. 10. In an exemplary embodiment, the insulating panel 32 includes the facer 36*a* but does not include the facer 36*b* , as shown in FIG. 9. In an exemplary embodiment, the insulating panel 32 includes the facer 36*b* but does not include the facer 36*a* , as shown in FIG. 8.

In several exemplary embodiments, the thickness $T_1$ of the insulating panel 32 is in the range of 0.5" to 4.5". In several exemplary embodiments, the thickness $T_1$ of the insulating panel 32 is in the range of 0.5" to 4.5", with corresponding thermal resistance values (R-values) of the sheathing panel 26 in the range of 3.0 to 31.5 (°F*ft$^2$*hr/Btu). In several exemplary embodiments, the thickness $T_1$ of the insulating panel 32 is about 1", with a corresponding thermal resistance value (R-value) of about 6.0 (°F*ft$^2$*hr/Btu). In several exemplary embodiments, the thickness $T_1$ of the insulating panel 32 is about 1", with a corresponding thermal resistance value (R-value) of about 6.5 (°F*ft$^2$*hr/Btu). In several exemplary embodiments, the thermal resistance value (R-value) of the insulating panel 32 is in the range of 6.0-6.5 (°F*ft$^2$*hr/Btu). In several exemplary embodiments, the thickness $T_1$ of the insulating panel 32 is in the range of 0.5" to 2".

In several exemplary embodiments, the width $W_1$ of the insulating panel 32 is 48". In several exemplary embodiments, the length $L_1$ of the insulating panel 32 is 96". In several exemplary embodiments, the length $L_1$ of the insulating panel 32 is in the range of 96" to 120". In several exemplary embodiments the width $W_1$ of the insulating panel 32 is 48" and the length $L_1$ of the insulating panel 32 is 96". Although possible dimensions for the thickness $T_1$, the width $W_1$, and the length $L_1$ of the insulating panel 32 have been described above, different dimensions could also be utilized depending on the specific characteristics of the roof system 14, or a different roof system, in which the sheathing panels 26 are incorporated.

The nail board 34 defines a thickness $T_2$, a length $L_2$, and a width $W_2$. In an exemplary embodiment, the thickness $T_2$ of the nail board 34 is 7/16". However, the thickness $T_2$ of the nail board 34 may be greater than 7/16" if necessary to increase the roof diaphragm 18's structural load capacity. Additionally, the nail board 34 is made of oriented strand board ("OSB") manufactured in accordance with DOC PS 2 (*Performance Standard for Wood-Based Structural-Use Panels*). The OSB is formed, for example, by mixing wood strands with resins (arranged in layers for design strength and stability) and bonding the wood strands together with the resins under heat and pressure. The OSB must be of a consistent composition and manufactured to be free of knots, grain defects, core voids, splits, and other irregularities. The OSB may be sealed along one or more edges thereof for added moisture resistance and dimensional stability. Finally, the OSB may include a course-textured top surface to facilitate safe footing on pitched roofs. In several alternative embodiments, the nail board 34 is made of plywood (CDX or another grade) instead of OSB. In several exemplary embodiments, the nail board 34 is fire treated. In several exemplary embodiments, the nail board 34 is not fire treated.

In several exemplary embodiments, the thickness $T_2$ of the nail board 34 is in the range of 3/8" to 1". In several exemplary embodiments, the width $W_2$ of the nail board 34 is 48". In several exemplary embodiments, the width $W_2$ of the nail board 34 is 3'11-7/8". In several exemplary embodiments, the width $W_2$ of the nail board 34 is in the range of 3'11-3/4" to 48". In several exemplary embodiments, the width $W_2$ of the nail board 34 is about 1/8" less than the width $W_1$ of the insulating panel 32. In several exemplary embodiments, the width $W_2$ of the nail board 34 is in the range of 1/16" to 1/4" less than the width $W_1$ of the insulating panel 32. In several exemplary embodiments, the length $L_2$ of the nail board 34 is 96". In several exemplary embodiments, the length $L_2$ of the nail board 34 is in the range of 96" to 120". In several exemplary embodiments, the length $L_2$ of the nail board 34 is 7'11-7/8". In several exemplary embodiments, the length $L_2$ of the nail board 34 is in the range of 7'11-3/4" to 96". In several exemplary embodiments, the length $L_2$ of the nail board 34 is about 1/8" less than the length $L_1$ of the insulating panel 32. In several exemplary embodiments, the length $L_2$ of the nail board 34 is in the range of 1/16" to 1/4" less than the length $L_1$ of the insulating panel 32.

In several exemplary embodiments, the width $W_2$ of the nail board 34 is about 1/8" less than the width $W_1$ of the insulating panel 32 and the length $L_2$ of the nail board 34 is about 1/8" less than the length $L_1$ of the insulating panel 32. In several exemplary embodiments, the width $W_2$ of the nail board 34 is in the range of 1/16" to 1/4" less than the width $W_1$ of the insulating panel 32 and the length $L_2$ of the nail board 34 is in the range of 1/16" to 1/4" less than the length $L_1$ of the insulating panel 32. Although possible dimensions for the thickness $T_2$, the width $W_2$, and the length $L_2$ of the nail board 34 have been described above, different dimensions could also be utilized depending on the specific characteristics of the roof system 14, or a different roof system, in which the sheathing panels 26 are incorporated.

In an exemplary embodiment of the sheathing panel 26, the insulating panel 32 includes Class A polyiso, which meets a flame spread requirement of equal to or less than 25, per ASTM E84, and is approved for use without a thermal barrier or an ignition barrier, per the applicable Sections of the IBC and the IRC; the facers 36*a* and 36*b* are glass fiber reinforced aluminum foil facers, with at least the facer 36*b* defining a heavy 12 mil thickness; the nail board 34 is made of OSB manufactured in accordance with DOC PS 2, with the thickness $T_2$ of the nail board 34 being 7/16"; and the fasteners 28 are Rmax® Nail Board Fasteners.

Figure 3:
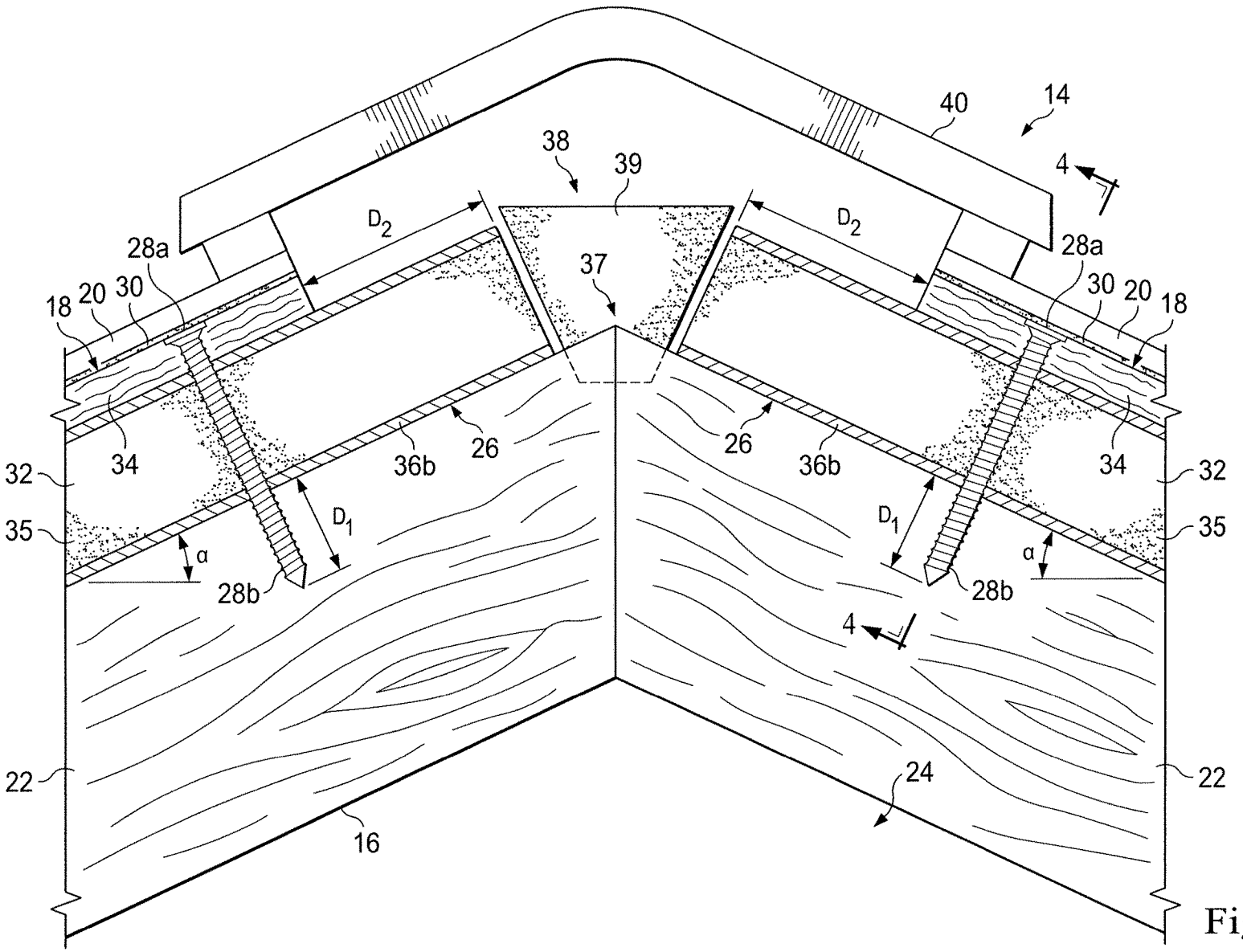
FIG. 3 is a sectional view of the roof system of FIG. 1 in an assembled condition, according to an exemplary embodiment.
Figure 4:
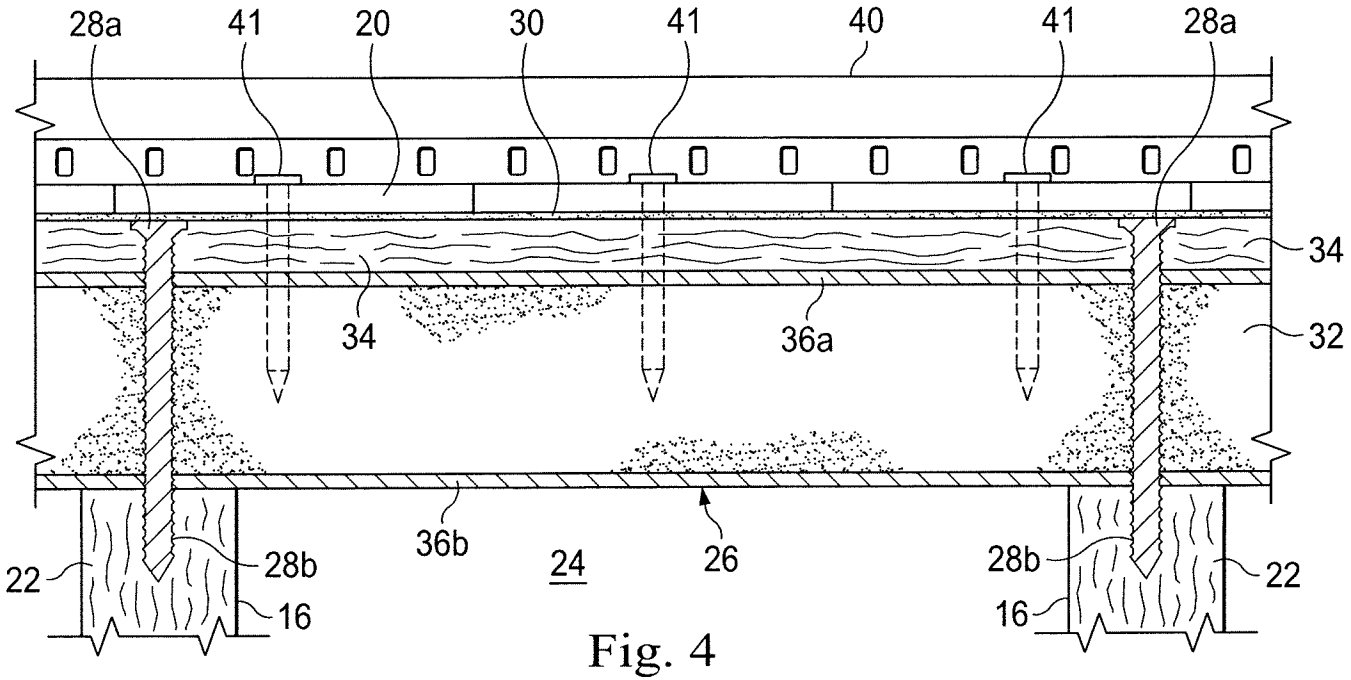
FIG. 4 is a sectional view of the roof system of FIGS. 1 and 3, taken along the line 4-4 of FIG. 3, according to an exemplary embodiment.

Referring to FIGS. 3 and 4, with continuing reference to FIGS. 1 and 2, a sectional view of the assembled roof system 14 is illustrated. The roof diaphragm 18 is positioned adjacent the roof frame 16 so that each of the sheathing panels 26 defines an angle of inclination a from horizontal. In several exemplary embodiments, the building structure 10 is a residential building structure and the respective angles of inclination a of the sheathing panels 26 are equal to or greater than 10 degrees. The sheathing panels 26 are connected to the roof structural members 22 with the nail board fasteners 28. As a result, respective head portions 28*a* of the nail board fasteners 28 abut, or nearly abut, the nail boards 34 and respective body portions 28*b* of the nail board fasteners 28 extend through the nail boards 34, through the insulating panels 32, and into the roof structural members 22 to a depth $D_1$. In several exemplary embodiments, the head portions 28*a* of the nail board fasteners 28 are omitted. In several exemplary embodiments, the nail board fasteners 28 extend at an angle into the roof structural members 22. When the roof diaphragm 18 is connected to the roof frame 16, the insulating panels 32 are positioned between the nail boards 34 and the roof frame 16 so that the insulating panels 32 engage the roof structural members 22, but the nail boards 34 do not engage the roof frame 16. In this position, the insulating panels 32, including the foam cores 35 and the facers 36*a* and 36*b*, act as a thermal envelope resisting heat transfer through the roof diaphragm 18. Moreover, respective portions of the facers 36*b* are exposed to the attic space 24 and are thus visible within the attic space 24, providing an aesthetically appealing interior finish to the attic space 24.

The uppermost rows of the sheathing panels 26 are disposed on opposing sides of a ridge 37 of the roof frame 16. In several exemplary embodiments, the roof diaphragm 18 is vented such that a gap 38 is defined between the uppermost rows of the sheathing panels 26 at or near the ridge 37. A ridge filler 39 fits within the gap 38, thus permitting the ventilation of vapor from the attic space 24 to atmosphere. Moreover, the ridge filler 39 includes a closed-cell rigid polyiso foam wedge. In several exemplary embodiments, the ridge filler 39 is manufactured in accordance with ASTM C1289. In several exemplary embodiments, the ridge filler 39 is Rmax® TSX-8500 thermal insulation board. In an exemplary embodiment, the ridge filler 39 includes Class A polyiso, which meets a flame spread requirement of equal to or less than 25, per ASTM E84, and is approved for use without a thermal barrier or an ignition barrier, per the applicable Sections of the IBC and the IRC. Alternatively, the ridge filler 39 may include Class B or Class C polyiso. In several exemplary embodiments, the ridge filler 39 is another foam plastic material such as, for example, extruded or expanded polystyrene. In several exemplary embodiments, the ridge filler 39 is omitted in favor of another permeable insulation, such as, for example, a rigid foam or spray foam, another foam plastic material, mineral wool/fiber, phenolic, or the like. In several exemplary embodiments, the ridge filler 39 includes a facer on its upper portion, a facer on its lower portion, respective facers on one or both of its side portions, or any combination thereof; in several exemplary embodiments, each of such facers is substantially similar to the facer 36*a* or 36*b*. In several exemplary embodiments, the roof diaphragm 18 is unvented such that the gap 38 is omitted and the uppermost edges of the insulating panels 32 on opposing sides of the ridge 37 are mitered to fit snugly together.

The widths $W_2$ of the nail boards 34 in the uppermost rows of the sheathing panels 26 (i.e., the rows adjacent the ridge 37 of the roof system 14) are each reduced by a dimension $D_2$ along the uppermost edges of the nail boards 34. In several exemplary embodiments, the dimensions $D_2$ by which the widths $W_2$ of the nail boards 34 in the uppermost rows of the sheathing panels 26 are reduced are in the range of 4" to 8". Such a reduction of the widths $W_2$ in the uppermost rows of the sheathing panels 26 permits the installation of a ridge vent 40 (shown in FIG. 3) while preventing, or at least reducing, condensation and/or wood rot adjacent the ridge vent 40. The ridge vent 40 straddles the ridge 37 of the roof system 14 and is connected at or near the uppermost edges of the nail boards 34 in the uppermost rows of the sheathing panels 26. The roof cover 20 and the sheeting 30 are installed over the roof diaphragm 18 with a plurality of roofing fasteners 41 (shown in FIG. 4), which extend through the nail board 34 and are embedded into the insulating panel 32. As a result, the roofing fasteners 41 are not exposed within the attic space 24, thus providing an aesthetically appealing interior finish (the fasteners 41 cannot be seen from the attic space 24), and also providing improved safety within the attic space 24 (there is less of a chance that the fasteners 41 will poke or cut a person who is in the attic space 24). In several exemplary embodiments, the roofing fasteners 41 are, or include, roofing insulation screws, ring-shank nails, spiral-shank nails, bolts, staples, other types of screws, other types of nails, and/or other types of fasteners.

Figure 5:
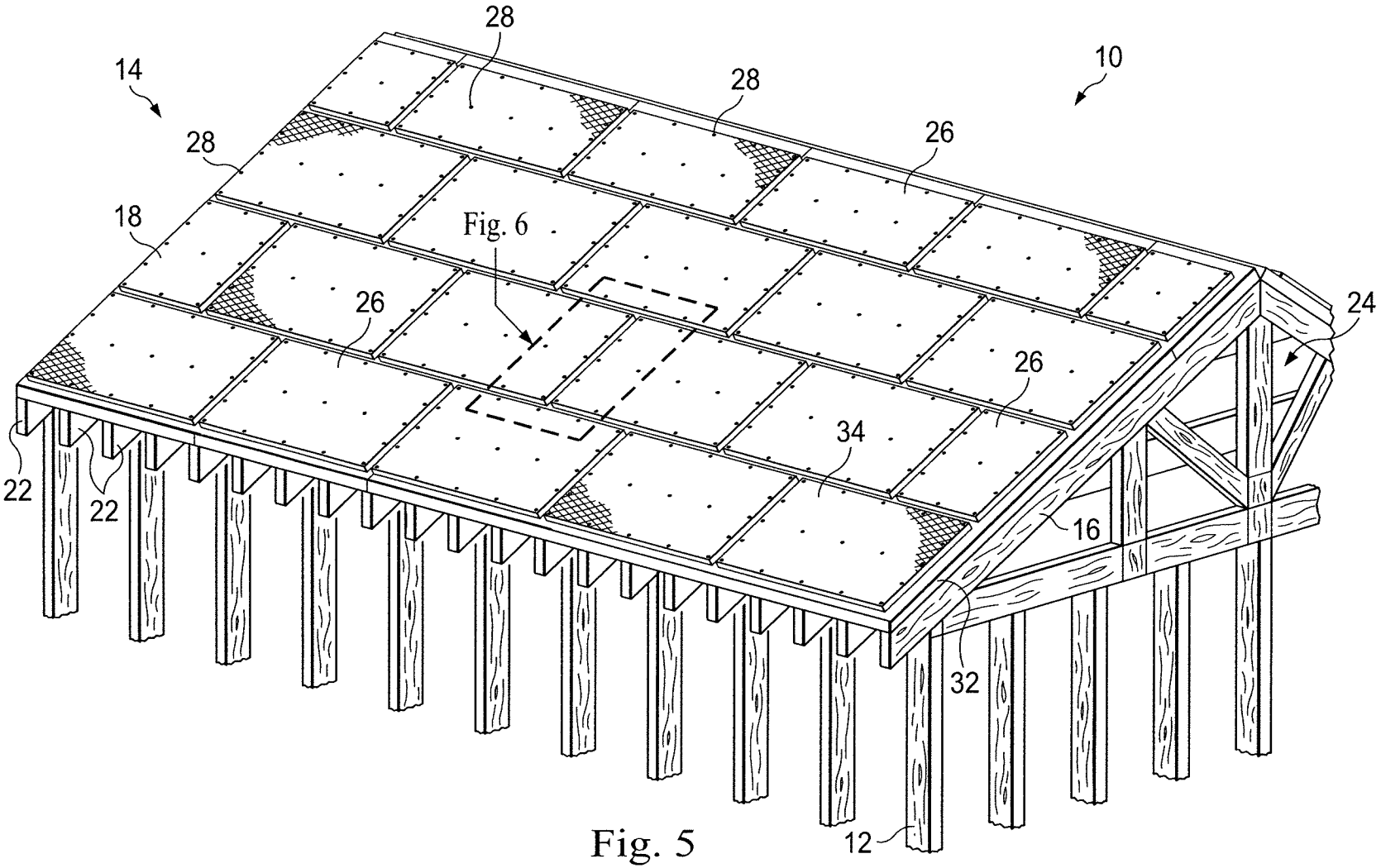
FIG. 5 is a perspective view of the roof diaphragm of the roof system of FIGS. 1 in an assembled condition, according to an exemplary embodiment.

Referring to FIG. 5, with continuing reference to FIGS. 1-4, an exemplary embodiment of the roof system 14 is illustrated in an assembled condition. The roof cover 20 and the sheeting 30 are omitted from FIG. 5 to more clearly show the roof diaphragm 18. The sheathing panels 26 of the roof diaphragm 18 are installed horizontally, so that the length dimension of the sheathing panels 26 extends perpendicular to the direction of extension of the roof structural members 22 to which the sheathing panels 26 are connected. Moreover, the roof diaphragm 18 is installed so that the vertically extending joints between the sheathing panels 26 extend along, and are positioned immediately above, the roof structural members 22. In several exemplary embodiments, the sheathing panels 26 are each installed to cover at least two (2) spans between adjacent ones of the roof structural members 22. Additionally, the sheathing panels 26 are installed so that the joints therebetween are staggered in each succeeding row. In several exemplary embodiments, the distance on center by which the roof structural members 22 are spaced apart does not exceed 24".

The installed roof diaphragm 18 provides a continuous layer of thermal insulation and a suitable substrate for the application of the roof cover 20 (e.g., shingles, tiles, metal roofing materials, and/or the like). As a result, the roof diaphragm 18 allows for efficient temperature control in the building structure 10, including at least the attic space 24 (regardless of whether the interior ceiling of the building structure 10 is flat or vaulted). Moreover, once the roof cover 20 has been installed over the roof diaphragm 18 with the plurality of roofing fasteners 41 (shown in FIG. 4), the roofing fasteners 41 extend through the nail board 34 and are embedded into the insulating panel 32 so that the roofing fasteners 41 are not exposed within the attic space 24, thus providing an aesthetically appealing interior finish and improved safety within the attic space 24.

In several exemplary embodiments, the roof diaphragm 18 reduces thermal losses due to thermal bridging (e.g., at the roof structural members 22). In several exemplary embodiments, the roof diaphragm 18 decreases shifting and/or relative movement between one or more components of the roof system 14 and one or more other components of the roof system 14, thereby reducing mechanical stress on the building structure 10.

In an exemplary embodiment, the fastening pattern for securing one of the sheathing panels 26 to the roof frame 16 includes, for example, at least fifteen (15) of the nail board fasteners 28. In several exemplary embodiments, the nail board fasteners 28 are spaced apart by, for example, about 6" on center along the respective perimeters of the sheathing panels 26. In several exemplary embodiments, the nail board fasteners 28 are spaced apart by, for example, about 12" on center in the respective fields of the sheathing panels 26. In several exemplary embodiments, the nail board fasteners 28 are positioned, for example, at least ⅜" from the edges of the nail boards 34. In several exemplary embodiments, the nail board fasteners 28 are corrosion resistant. In several exemplary embodiments, the nail board fasteners 28 are, or include, roofing insulation screws, ring-shank nails, spiral-shank nails, bolts, other types of screws, other types of nails, and/or other types of fasteners. In several exemplary embodiments, the nail board fasteners 28 are Rmax® Nail Board Fasteners. Although possible values for the number of fasteners 28 per sheathing panel 26, the perimeter spacing of the fasteners 28, and the field spacing of the fasteners 28 have been described above, different values could also be utilized depending on the specific characteristics of the roof system 14, or a different roof system, in which the sheathing panels 26 are incorporated. In several exemplary embodiments, to provide additional support to the edges of the sheathing panels 26, a plurality of H-clips or sheathing clips (not shown) may be placed so as to bridge adjacent ones of the sheathing panels 26 together at locations between the supporting roof structural members 22. In addition to, or instead of, the H-clips, a plurality of solid blocking members (not shown) may be employed to provide additional support to the edges of the sheathing panels 26.

Figure 6:
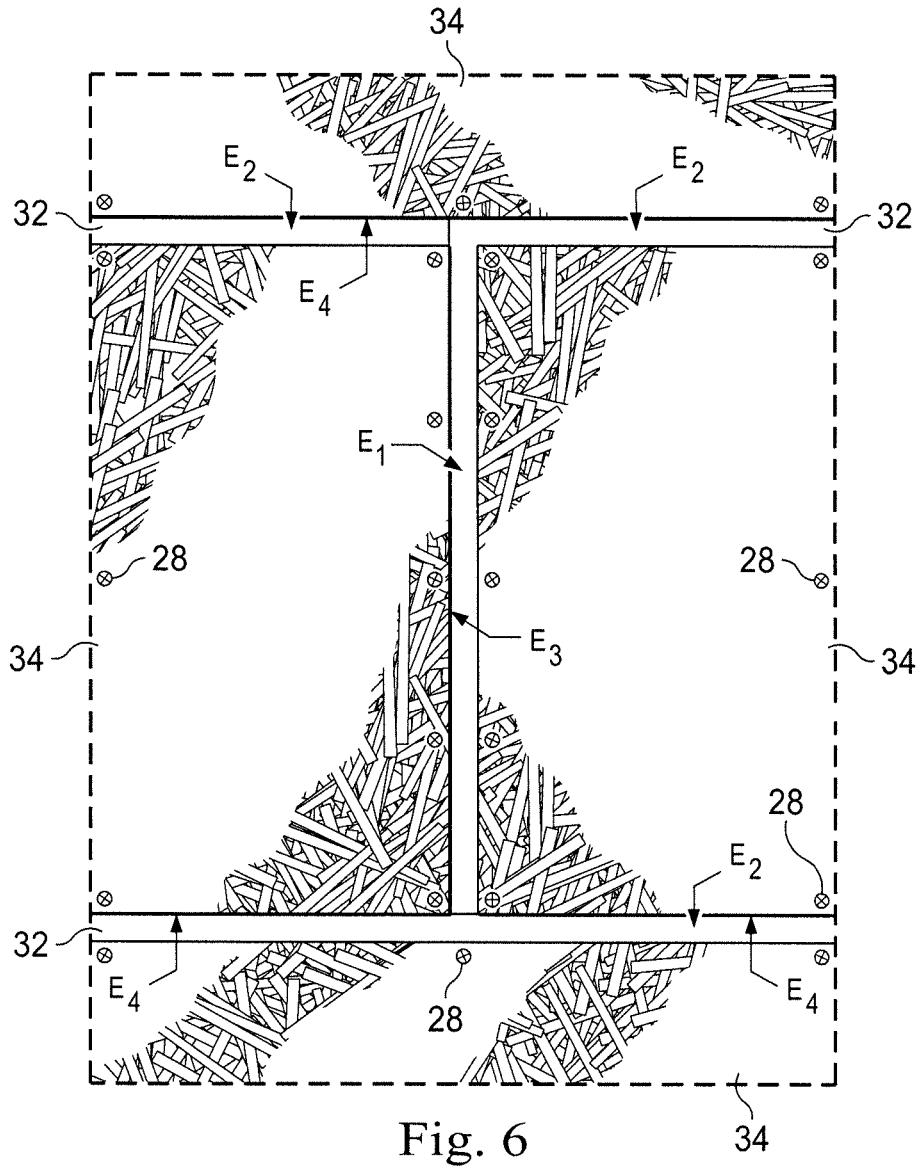
FIG. 6 is an enlarged view of a portion of the roof diaphragm of FIG. 5, according to an exemplary embodiment.

Referring now to FIG. 6, which is an enlarged view of a portion of the roof system 14 of FIG. 5, in several exemplary embodiments, the insulating panels 32 project beyond the nail boards 34 along at least two (2) adjacent edge portions $E_1$ and $E_2$ of the sheathing panels 26, leaving the insulating panels 32 flush with the nail boards 34 along the remaining edge portions $E_3$ and $E_4$ of the sheathing panels 26. As a result, when the sheathing panels 26 are installed on the roof frame 16, adjacent ones of the insulating panels 32 engage on another other while a minimum spacing is maintained between adjacent ones of the nail boards 34. Thus, the sheathing panels 26 are engineered to allow for proper spacing during installation and to permit normal expansion of the nail boards 34 without gapping of the insulating panels 32. To this end, once installed, the sheathing panels 26 should be permitted time to adjust to humidity and moisture conditions before installation of the roof cover 20. In several exemplary embodiments, the portion of the roof system 14 shown in FIG. 6 is, includes, or is part of, the roof diaphragm 18 or a section thereof.

In several exemplary embodiments, at least the respective thicknesses $T_1$ and $T_2$ of the insulating panels 32 and the nail boards 34 are sized so that a thermal resistance value (R-value) of the roof diaphragm 18 is at least about 3.0 (or 3.2) (°F*ft$^2$*hr/Btu), in accordance with IRC Section N1102 and *International Energy Conservation Code* (the "IECC") Section 402. In several exemplary embodiments, at least the respective thicknesses $T_1$ and $T_2$ of the insulating panels 32 and the nail boards 34 are sized so that the R-value of the roof diaphragm 18 is greater than 3.2 (°F*ft$^2$*hr/Btu), in accordance with IRC Section N1102 and IECC Section 402. In several exemplary embodiments, at least the respective thicknesses $T_1$ and $T_2$ of the insulating panels 32 and the nail boards 34 are sized so that the R-value of the roof diaphragm 18 is in the range of 3.0 to 31.5 (°F*ft$^2$*hr/Btu), in accordance with IRC Section N1102 and IECC Section 402.

In several exemplary embodiments, the nail board fasteners 28 are sized so that the depths $D_1$ to which the respective body portions **28*b* of the nail board fasteners 28 penetrate the roof structural members 22 is at least 1", at least 1-¼", or at least 1 ½". In several exemplary embodiments, at least the respective thicknesses $T_1$ and $T_2$ of the insulating panels 32 and the nail boards 34 are sized so that, when the respective head portions 28*a* of the nail board fasteners 28 abut, or nearly abut, the nail boards 34 and the respective body portions 28*b* of the nail board fasteners 28 extend through the nail boards 34, through the insulating panels 32, and into the roof structural members 22, the depths $D_1$ to which the respective body portions 28*b* of the nail board fasteners 28 penetrate the roof structural members 22** is at least 1", at least 1-¼", or at least 1-½".

In several exemplary embodiments, the nail board fasteners 28 are sized so that the depths $D_1$ to which the respective body portions **28*b* of the nail board fasteners 28 penetrate the roof structural members 22 are sufficient to enable the roof diaphragm 18 to resist structural loads in accordance with IBC Chapter 16 and IRC Chapter 3 for roof loads. In several exemplary embodiments, at least the respective thicknesses $T_1$ and $T_2$ of the insulating panels 32 and the nail boards 34 are sized so that, when the respective head portions 28*a* of the nail board fasteners 28 abut, or nearly abut, the nail boards 34 and the respective body portions 28*b* of the nail board fasteners 28 extend through the nail boards 34, through the insulating panels 32, and into the roof structural members 22, the depths $D_1$ to which the respective body portions 28*b* of the nail board fasteners 28 penetrate the roof structural members 22 are sufficient to enable the roof diaphragm 18** to resist structural loads in accordance with IBC Chapter 16 and IRC Chapter 3 for roof loads.

In several exemplary embodiments, the roof diaphragm 18 is used as thermal insulation on the exterior side of an unvented or vented roof assembly. In several exemplary embodiments, the roof diaphragm 18 meets the continuous insulating sheathing requirements complying with the provisions of IECC Section 402. In several exemplary embodiments, the roof diaphragm 18 has a thermal resistance value (R-value) in the range of 6.5 to 31.5 (°F*ft$^2$*hr/Btu).

In several exemplary embodiments, the roof diaphragm 18 may be installed on roofs complying with the IRC or roofs complying with the IBC for Type V constructions when separated from the interior with a thermal barrier consisting of a minimum ½" gypsum wallboard or an approved equivalent in accordance with IRC Section R316.4 and IBC Section 2603.4. In several exemplary embodiments, the roof diaphragm 18 is specifically approved for use without a thermal barrier or an ignition barrier as prescribed by IRC Section R316.4 through R316.5.13, as applicable, and IBC Sections 2603.4 and 2603.6, based on large-scale testing conducted in accordance with UL 1715 (*Standard for Fire Test of Interior Finish Material*), per IRC Section R316.6 and IBC Section 2603.10. Specifically, the roof diaphragm 18 is permitted to be used without a thermal barrier or an ignition barrier where the thickness $T_1$ of the insulating panels 32 does not exceed 4.5 ". Alternatively, the roof diaphragm 18 may be specifically approved for use without a thermal barrier or an ignition barrier based on testing conducted in accordance with NFPA 286 (*Standard Methods of Fire Tests for Evaluating Contribution of Wall and Ceiling Interior Finish to Room Fire Growth*), FM 4880 (*Approval Standard for Class* 1 *Fire Rating of Insulated Panels, Interior Finish Materials or Coatings and Exterior Wall Systems*), or UL 1040 (*Standard for Fire Test of Insulated Wall Construction*). In several exemplary embodiments, the roof diaphragm 18 may be installed on roofs complying with the IBC for Types I, II, III, IV, or V constructions when separated from the interior with a thermal barrier consisting of a minimum ½" gypsum wallboard or an approved equivalent in accordance with IRC Section R316.4 and IBC Section 2603.4. In several exemplary embodiments, the roof diaphragm 18 may be installed on roofs complying with the IBC for Types I, II, Ill, IV, or V constructions. In several exemplary embodiments, the roof structural members 22 on which the roof diaphragm 18 is installed are made of wood, metal, or other types of materials.

Figure 7:
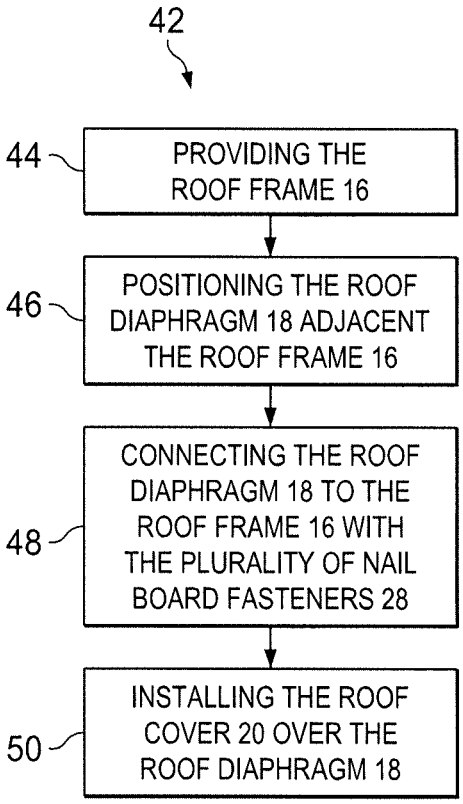
FIG. 7 is a flow chart illustration of a method of installing the roof system of FIGS. 1-6, according to an exemplary embodiment.

Referring to FIG. 7, with continuing reference to FIGS. 1-6, an exemplary embodiment of a method of installing the roof system 14 is generally referred to by the reference numeral 42. The method 42 includes providing the roof frame 16 at step 44, positioning the roof diaphragm 18 adjacent the roof frame 16 at step 46, connecting the roof diaphragm 18 to the roof frame 16 with the plurality of nail board fasteners 28 at step 48, and installing the roof cover 20 over the roof diaphragm 18 with the plurality of roofing fasteners 41 at step 50.

At the step 44, the roof frame 16 is provided. In an exemplary embodiment, providing the roof frame 16 includes preparing the roof structural members 22, which may include rafters, ceiling joists, collars, hangers, struts, purlins, fasciae, ridge boards, solid blocking members, and/or the like, for the installation of the roof diaphragm 18. Accordingly, providing the roof frame 16 may include constructing the roof frame 16 on top of the wall system 12 using the roof structural members 22. Alternatively, providing the roof frame 16 may include removing a used, worn, and/or obsolete roof diaphragm from an existing roof frame, so that the existing roof frame may be retrofitted with the roof diaphragm 18. In several exemplary embodiments, the distance on center by which the roof structural members 22 are spaced apart does not exceed 24".

At the step 46, the roof diaphragm 18 is positioned adjacent the roof frame 16. In an exemplary embodiment, positioning the roof diaphragm 18 adjacent the roof frame 16 includes positioning the sheathing panels 26 adjacent the roof structural members 22. Specifically, the sheathing panels 26 are arranged so that the joints therebetween occur along the roof structural members 22. Moreover, the sheathing panels 26 are arranged so that the joints therebetween are staggered in each succeeding row. In several exemplary embodiments, the sheathing panels 26 are each arranged to cover at least two (2) spans between adjacent ones of the roof structural members 22.

At the step 48, the roof diaphragm 18 is connected to the roof frame 16 with the plurality of nail board fasteners 28. In an exemplary embodiment, connecting the roof diaphragm 18 to the roof frame 16 includes connecting the sheathing panels 26 to the roof structural members 22 with the plurality of nail board fasteners 28. Specifically, the nail board fasteners 28 are driven into the nail boards 34 so that the respective heads 28*a* of the nail board fasteners 28 abut, or nearly abut, the nail boards 34 and the respective bodies 28*b* of the nail board fasteners 28 extend through the nail boards 34, through the insulating panels 32, and into the roof structural members 22 to the depths $D_1$. When the sheathing panels 26 are connected to the roof frame 16 with the plurality of nail board fasteners 28, the insulating panels 32 are positioned between the nail boards 34 and the roof structural members 22 so that the insulating panels 32 engage the roof frame 16, but the nail boards 34 do not engage the roof frame 16. In several exemplary embodiments, the depths $D_1$ to which the respective bodies 28*b* of the nail board fasteners 28 penetrate the roof frame 16 are sufficient to enable the roof diaphragm 18 to resist structural loads in accordance with IBC Chapter 16 and IRC Chapter 3 for roof loads.

At the step 50, the roof cover 20 is installed over the roof diaphragm 18 with the plurality of roofing fasteners 41. The roof cover 20, which may include shingles, tiles, metal roofing materials, or the like, is installed over the roof diaphragm 18 to at least partially weatherproof the building structure 10. Additionally, the sheeting 30 (e.g., roofing felt) is installed beneath the roof cover 20 to provide additional weatherproofing. In several exemplary embodiments, installing the roof cover 20 over the roof diaphragm 18 includes driving the plurality of roofing fasteners 41 (shown in FIG. 4) through the nail boards 34 and into the insulating panels 32 so that the insulating panels 32 prevent, or at least reduce, the exposure of the roofing fasteners 41 within the attic space 24.

Referring to FIG. 8, with continuing reference to FIGS. 1-7, a sectional view of a roof system 52 is illustrated in an assembled state. The roof system 52 includes several parts that are substantially identical to corresponding parts of the roof system 14, which identical parts are given the same reference numerals. However, in the roof system 52, the sheathing panels 26 are replaced with sheathing panels 54. The sheathing panels 54 each include several features that are substantially identical to corresponding features of the sheathing panel 26, which identical features are given the same reference numerals. The facer 36*a* is omitted from the sheathing panel 54. As a result, the sheathing panel 54 includes only the facer 36*b* on a side thereof opposite the nail board 34, and the foam core 35 is bonded to the nail board 34. The foam core 35 of the sheathing panel 54 includes one or both of a closed-cell rigid polyiso foam core and a polystyrene foam core. The nail board 34 of the sheathing panel 54 includes one or both of oriented strand board (OSB) and plywood. In several exemplary embodiments, each of the sheathing panels 54 is, includes, or is part of, the roof diaphragm 18 or a section thereof. The sheathing panels 54 are connected to the roof structural members 22 with nail board fasteners 56 in a manner similar to the manner in which the nail board fasteners 28 connect the sheathing panels 26 to the roof structural members 22. In several exemplary embodiments, the nail board fasteners 56 are substantially identical to the nail board fasteners 28. As a result, the respective nail board fasteners 56 extend through the nail boards 34, through the insulating panels 32, and into the roof structural members 22 to the depth $D_1$. In several exemplary embodiments, the nail board fasteners 56 extend at an angle into the roof structural members 22.

When the roof diaphragm 18, including the sheathing panels 54, is connected to the roof frame 16, the insulating panels 32 are positioned between the nail boards 34 and the roof frame 16 so that the insulating panels 32, and specifically the respective facers 36*b* of the insulating panels 32, engage the roof structural members 22. The nail boards 34 do not engage the roof structural members 22. In this position, the insulating panels 32, including the foam cores 35 and the facers 36*b*, act as a thermal envelope resisting heat transfer through the roof diaphragm 18. Moreover, respective portions of the facers 36*b* are exposed to the attic space 24 and are thus visible within the attic space 24, providing an aesthetically appealing interior finish to the attic space 24. These respective portions of the facers 36*b* each extend between adjacent ones of the roof structural members 22. The roof cover 20 and the sheeting 30 are installed over the roof diaphragm 18 with the plurality of roofing fasteners 41, which extend through the nail board 34 and are embedded into the insulating panel 32. The manner in which the roof cover 20, the sheeting 30, and the roofing fasteners 41 are installed over the sheathing panels 54 is substantially identical to the manner in which these components are installed over the sheathing panels 26.

In several exemplary embodiments, the step 46 of the method 42 includes positioning the sheathing panels 54 adjacent the roof structural members 22 rather than positioning the sheathing panels 26 adjacent the roof structural members 22. The manner in which the sheathing panels 54 are arranged on the roof structural members 22 at the step 46 is substantially identical to the manner in which the sheathing panels 26 are arranged on the roof structural members 22.

In several exemplary embodiments, the step 48 of the method 42 includes connecting the roof diaphragm 18, including the sheathing panels 54, to the roof frame 16 with the plurality of nail board fasteners 56 (rather than the nail board fasteners 28). The nail board fasteners 56 are driven into the nail boards 34 in substantially the same manner as the manner in which the nail board fasteners 28 are driven into the nail boards 34. As a result, the respective nail board fasteners 56 extend through the nail boards 34, through the insulating panels 32, and into the roof structural members 22 to the depths $D_1$. When the sheathing panels 54 are connected to the roof frame 16 with the plurality of nail board fasteners 56, the insulating panels 32 are positioned between the nail boards 34 and the roof structural members 22 so that the insulating panels 32 engage the roof frame 16.

The present disclosure refers to the following documents: IBC Chapter 16; IBC Section 2603; IRC Chapter 3; IRC Section R316; IRC Section N1102; ASTM E84; ASTM C1289; DOC PS 2; UL 1040; UL 1715; FM 4880; and NFPA 286, the entire disclosures of which are hereby incorporated herein by reference.

In a first aspect, the present disclosure introduces a roof system, including a roof frame; a roof diaphragm connected to the roof frame, the roof diaphragm including a nail board including one or both of: oriented strand board (OSB); and plywood; and an insulating panel connected to the nail board, the insulating panel including a foam core including one or both of: a closed-cell rigid polyisocyanurate (polyiso) foam core; and a polystyrene foam core; and a facer covering a side of the foam core opposite the nail board; a plurality of nail board fasteners connecting the roof diaphragm to the roof frame, the nail board fasteners each extending through the nail board, through the insulating panel, and into the roof frame; and an attic space at least partially defined by the roof frame and the roof diaphragm; wherein the facer acts as a radiant barrier; wherein the roof frame includes first and second roof structural members into which respective ones of the nail board fasteners extend; wherein the insulating panel is positioned between the nail board and each of the first and second roof structural members so that: the facer is engaged with each of the first and second roof structural members; a portion of the facer extends between the first and second roof structural members; the portion of the facer is exposed to the attic space and is thus visible within the attic space; and the nail board does not engage either the first roof structural member or the second roof structural member. In an exemplary embodiment, the roof system further includes a roof cover installed over the roof diaphragm with a plurality of roofing fasteners, each of the roofing fasteners extending through the nail board and into the insulating panel so that the insulating panel prevents, or at least reduces, the exposure of the roofing fasteners within the attic space. In an exemplary embodiment, the insulating panel, including the foam core and the facer, acts as a thermal envelope resisting heat transfer through the roof diaphragm.

In a second aspect, the present disclosure introduces a roof system including a roof diaphragm, the roof diaphragm including a nail board and an insulating panel connected to the nail board, the roof diaphragm being adapted to be positioned adjacent a roof frame so that the insulating panel engages the roof frame. In an exemplary embodiment, the insulating panel and the nail board define first and second thicknesses, respectively; and at least the respective first and second thicknesses of the insulating panel and the nail board are sized so that a thermal resistance value (R-value) of the roof diaphragm is at least about 3.0 ($°F*ft^2*hr/Btu$). In an exemplary embodiment, the nail board includes one or both of: oriented strand board (OSB); and plywood. In an exemplary embodiment, the insulating panel includes one or both of: a closed-cell rigid polyiso foam core; and a polystyrene foam core. In an exemplary embodiment, the roof system further includes the roof frame; a plurality of nail board fasteners connecting the roof diaphragm to the roof frame, the nail board fasteners each extending through the nail board, through the insulating panel, and into the roof frame to a depth; wherein the insulating panel is positioned between the nail board and the roof frame so that the insulating panel engages the roof frame. In an exemplary embodiment, the insulating panel and the nail board define first and second thicknesses, respectively; and the nail board fasteners and at least the respective first and second thicknesses of the insulating panel and the nail board are sized so that the depths to which the respective nail board fasteners penetrate the roof frame are sufficient to enable the roof diaphragm to resist structural loads in accordance with IBC Chapter 16 and IRC Chapter 3 for roof loads. In an exemplary embodiment, the roof system further includes the roof frame to which the roof diaphragm is connected; wherein the insulating panel is positioned between the nail board and the roof frame so that the insulating panel engages the roof frame; wherein the roof frame and the roof diaphragm together define an attic space; and wherein the roof system further includes a roof cover installed over the roof diaphragm with a plurality of roofing fasteners, each of the roofing fasteners extending through the nail board and into the insulating panel so that the insulating panel prevents, or at least reduces, exposure of the roofing fasteners within the attic space. In an exemplary embodiment, the insulating panel includes a foam core and a first facer covering a side of the foam core opposite the nail board. In an exemplary embodiment, the insulating panel further includes a second facer covering a side of the foam core proximate the nail board.

In a third aspect, the present disclosure introduces a roof diaphragm section adapted to be connected to a roof frame, the roof diaphragm section including a sheathing panel adapted to extend adjacent the roof frame, the sheathing panel including a nail board and an insulating panel connected to the nail board; wherein, when the sheathing panel extends adjacent, and is connected to, the roof frame, the insulating panel is positioned between the nail board and the roof frame so that the insulating panel engages the roof frame. In an exemplary embodiment, the roof diaphragm section further includes a plurality of nail board fasteners adapted to connect the sheathing panel to the roof frame when the sheathing panel extends adjacent the roof frame, wherein, when the nail board fasteners connect the sheathing panel to the roof frame, the respective nail board fasteners extend through the nail board, through the insulating panel, and into the roof frame to a depth, thus connecting the roof diaphragm to the roof frame. In an exemplary embodiment, the insulating panel and the nail board define first and second thicknesses, respectively; and the nail board fasteners and at least the respective first and second thicknesses of the insulating panel and the nail board are sized so that, when the respective nail board fasteners extend through the nail board, through the insulating panel, and into the roof frame, the depths to which the respective nail board fasteners penetrate the roof frame are sufficient to enable the roof diaphragm to resist structural loads in accordance with IBC Chapter 16 and IRC Chapter 3 for roof loads. In an exemplary embodiment, the insulating panel and the nail board define first and second thicknesses, respectively; and at least the respective first and second thicknesses of the insulating panel and the nail board are sized so that, when the roof diaphragm is connected to the roof frame, a thermal resistance value (R-value) of the roof diaphragm is at least about 3.0 (°F*ft$^2$*hr/Btu). In an exemplary embodiment, the nail board includes one or both of: OSB; and plywood. In an exemplary embodiment, the insulating panel includes one or both of: a closed-cell rigid polyiso foam core; and a polystyrene foam core. In an exemplary embodiment, when the sheathing panel extends adjacent, and is connected to, the roof frame, the roof frame and the sheathing panel together define an attic space; and wherein the roof diaphragm further includes a roof cover adapted to be installed over the sheathing panel with a plurality of roofing fasteners, wherein each of the roofing fasteners is adapted to extend through the nail board and into the insulating panel so that the insulating panel prevents, or at least reduces, exposure of the roofing fasteners within the attic space. In an exemplary embodiment, the insulating panel includes a foam core and first facer covering a side of the foam core opposite the nail board. In an exemplary embodiment, the insulating panel further includes a second facer covering a side of the foam core proximate the nail board.

In a fourth aspect, the present disclosure introduces a method of installing a roof system, the method including positioning a roof diaphragm adjacent a roof frame, the roof diaphragm including a nail board and an insulating panel connected to the nail board; and connecting the roof diaphragm to the roof frame; wherein the roof diaphragm is positioned adjacent, and connected to, the roof frame so that: the insulating panel is positioned between the nail board and the roof frame; and the insulating panel engages the roof frame. In an exemplary embodiment, connecting the roof diaphragm to the roof frame includes driving a plurality of nail board fasteners into the nail board so that the respective nail board fasteners extend through the nail board, through the insulating panel, and into the roof frame to a depth. In an exemplary embodiment, the insulating panel and the nail board define first and second thicknesses, respectively; and the nail board fasteners and at least the respective first and second thicknesses of the insulating panel and the nail board are sized so that the depths to which the respective nail board fasteners penetrate the roof frame are sufficient to enable the roof diaphragm to resist structural loads in accordance with IBC Chapter 16 and IRC Chapter 3 for roof loads. In an exemplary embodiment, the insulating panel and the nail board define first and second thicknesses, respectively; and at least the respective first and second thicknesses of the insulating panel and the nail board are sized so that a thermal resistance value (R-value) of the roof diaphragm is at least about 3.0 (°F*ft$^2$*hr/Btu). In an exemplary embodiment, the nail board includes one or both of: OSB; and plywood. In an exemplary embodiment, the insulating panel includes one or both of: a closed-cell rigid polyiso foam core; and a polystyrene foam core. In an exemplary embodiment, when the roof diaphragm is positioned adjacent, and connected to, the roof frame, the roof frame and the roof diaphragm together define an attic space; and wherein the method further includes installing a roof cover over the roof diaphragm with a plurality of roofing fasteners, each of the roofing fasteners extending through the nail board and into the insulating panel so that the insulating panel prevents, or at least reduces, exposure of the roofing fasteners within the attic space. In an exemplary embodiment, the insulating panel includes a foam core and a first facer covering a side of the foam core opposite the nail board; the insulating panel, including the foam core and the first facer, acts as a thermal envelope resisting heat transfer through the roof diaphragm; and the first facer acts as a radiant barrier. In an exemplary embodiment, the insulating panel further includes a second facer covering a side of the foam core proximate the nail board.

It is understood that variations may be made in the foregoing without departing from the scope of the present disclosure.

In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A roof system, comprising:

a roof frame;

a roof diaphragm connected to the roof frame, the roof diaphragm comprising:

a nail board; and an insulating panel bonded to the nail board so that respective surfaces of the insulating panel and the nail board mate against one another, the insulating panel comprising:

a foam core; and a facer bonded to a side of the foam core opposite the nail board;

and an attic space at least partially defined by the roof frame and the roof diaphragm;

wherein the roof frame comprises first and second roof structural members;

wherein the insulating panel is positioned between the nail board and each of the first and second roof structural members so that:

first and second portions of the facer are engaged with the first and second roof structural members, respectively;

a third portion of the facer extends between the first and second roof structural members;

the third portion of the facer is exposed to the attic space and is thus visible within the attic space; and the nail board does not engage either the first roof structural member or the second roof structural member;

and wherein the facer, and thus the third portion of the facer exposed to the attic space and thus visible within the attic space, is a glass fiber reinforced aluminum foil facer, a glass fiber/organic mat facer, or an inorganic polymer coated glass fiber mat facer.

2. The roof system of claim 1, wherein:

the nail board defines a first length and a first width;

the insulating panel defines a second length and a second width;

the first length is less than the second length; and the first width is less than the second width.

3. The roof system of claim 1, wherein:

the roof diaphragm extends at an angle of inclination equal to or greater than 10 degrees from horizontal;

the facer is engaged with each of the first and second roof structural members along a plane;

the plane along which the facer engages each of the first and second roof structural members extends at the angle of inclination; and the portion of the facer extending between the first and second roof structural members and exposed to the attic space extends at the angle of inclination.

4. The roof system of claim 1, further comprising a plurality of roofing fasteners embedded into the insulating panel so that the insulating panel prevents exposure of respective distal ends of the roofing fasteners within the attic space.

5. The roof system of claim 4, further comprising:

a protective layer of sheeting installed over the roof diaphragm; and a roof cover installed over the protective layer of sheeting and the roof diaphragm;

wherein the roofing fasteners extend through the roof cover, the protective layer of sheeting, and the nail board, and into the insulating panel.

6. The roof system of claim 1, wherein the foam core includes a closed-cell rigid polyisocyanurate.

7. The roof system of claim 1, further comprising a plurality of nail board fasteners connecting the roof diaphragm to the roof frame, the nail board fasteners each extending through the nail board, through the insulating panel, and into the roof frame;

wherein respective ones of the nail board fasteners extend into the first and second roof structural members.

8. The roof system of claim 7, wherein the insulating panel and the nail board define first and second thicknesses, respectively; and wherein the nail board fasteners and at least the respective first and second thicknesses of the insulating panel and the nail board are sized so that respective depths to which the nail board fasteners penetrate the roof frame are at least 1 inch.

9. The roof system of claim 1, wherein the insulating panel further comprises another facer bonded to a side of the foam core proximate the nail board, the another facer defining the surface of the insulating panel that mates against the surface of the nail board.

10. The roof system of claim 9, wherein the another facer is a glass fiber reinforced aluminum foil facer, a glass fiber/organic mat facer, or an inorganic polymer coated glass fiber mat facer.

11. The roof system of claim 9, wherein the another facer comprises one or more of the following: foil; kraft; aluminum; glass fiber; glass mat; organic mat; inorganic mat; a coating; an aluminum reflective surface; hard temper foil; a 2-ply laminate of foil and kraft; a trilaminate of foil, kraft, and foil; a trilaminate of foil, kraft, and polyethylene terephthalate (PET); a coated glass mat; a layer of pure polyethylene terephthalate (PET).

12. A method of installing a roof system, the method comprising:

forming a roof diaphragm, the roof diaphragm comprising a nail board and an insulating panel bonded thereto, the insulating panel comprising a foam core;

after forming the roof diaphragm, positioning the roof diaphragm adjacent a roof frame;

and connecting the roof diaphragm to the roof frame, the roof diaphragm and the roof frame at least partially defining an attic space;

wherein the roof frame comprises first and second roof structural members;

wherein the insulating panel is positioned between the nail board and each of the first and second roof structural members so that:

first and second portions of the insulating panel are engaged with the first and second roof structural members, respectively;

a third portion of the insulating panel extends between the first and second roof structural members;

the third portion of the insulating panel is exposed to the attic space and is thus visible within the attic space; and the nail board does not engage either the first roof structural member or the second roof structural member.

13. The method of claim 12, wherein the insulating panel further comprises a facer, and wherein the facer is a glass fiber reinforced aluminum foil facer, a glass fiber/organic mat facer, or an inorganic polymer coated glass fiber mat facer.

14. The method of claim 12, wherein the insulating panel further comprises a facer that is positioned between the foam core of the insulating panel and each of the first and second roof structural members so that first, second, and third portions of the facer are the first, second, and third portions, respectively, of the insulating panel and thus:

the first and second portions of the facer are engaged with the first and second roof structural members, respectively;

the third portion of the facer extends between the first and second roof structural members; and the third portion of the facer is exposed to the attic space and is thus visible within the attic space.

15. The method of claim 14, wherein the facer is a glass fiber reinforced aluminum foil facer, a glass fiber/organic mat facer, or an inorganic polymer coated glass fiber mat facer.

16. The method of claim 12, wherein the insulating panel is positioned between the nail board and each of the first and second roof structural members so that first, second, and third portions of the foam core are the first, second, and third portions, respectively, of the insulating panel and thus:

the first and second portions of the foam core of the insulating panel are engaged with the first and second roof structural members, respectively;

the third portion of the foam core extends between the first and second roof structural members; and the third portion of the foam core is exposed to the attic space and is thus visible within the attic space.

17. The method of claim 12, wherein:

the nail board defines a first length and a first width;

the insulating panel defines a second length and a second width;

the first length is less than the second length; and the first width is less than the second width.

18. The method of claim 12, wherein positioning the roof diaphragm comprises:

positioning the roof diaphragm adjacent the roof frame so that the roof diaphragm extends at an angle of inclination equal to or greater than 10 degrees from horizontal;

wherein the insulating panel further comprises a facer that is positioned between the foam core of the insulating panel and each of the first and second roof structural members;

wherein the facer is engaged with each of the first and second roof structural members along a plane;

wherein the plane along which the facer engages each of the first and second roof structural members extends at the angle of inclination; and wherein the portion of the facer extending between the first and second roof structural members and exposed to the attic space extends at the angle of inclination.

19. The method of claim 12, further comprising:

embedding a plurality of roofing fasteners into the insulating panel so that the insulating panel prevents exposure of respective distal ends of the roofing fasteners within the attic space.

20. The method of claim 19, further comprising:

installing a protective layer of sheeting over the roof diaphragm; and installing a roof cover over the protective layer of sheeting and the roof diaphragm;

wherein the roofing fasteners extend through the roof cover, the protective layer of sheeting, and the nail board, and into the insulating panel.

21. The method of claim 12, wherein the foam core includes a closed-cell rigid polyisocyanurate.

22. The method of claim 12, wherein connecting the roof diaphragm to the roof frame comprises:

driving a plurality of nail board fasteners through the nail board, through the insulating panel, and into the roof frame;

wherein respective ones of the nail board fasteners extend into the first and second roof structural members.

23. The method of claim 22, wherein the insulating panel and the nail board define first and second thicknesses, respectively; and wherein the nail board fasteners and at least the respective first and second thicknesses of the insulating panel and the nail board are sized so that respective depths to which the nail board fasteners penetrate the roof frame are at least 1 inch.

24. The method of claim 12, wherein the insulating panel of the roof diaphragm further comprises a facer bonded to a side of the foam core proximate the nail board of the roof diaphragm, the facer defining a surface of the insulating panel that mates against a surface of the nail board.

25. The method of claim 24, wherein the facer is a glass fiber reinforced aluminum foil facer, a glass fiber/organic mat facer, or an inorganic polymer coated glass fiber mat facer.

26. The method of claim 12, wherein the insulating panel further comprises a facer, and wherein the facer comprises one or more of the following: foil; kraft; aluminum; glass fiber; glass mat; organic mat; inorganic mat; a coating; an aluminum reflective surface; hard temper foil; a 2-ply laminate of foil and kraft; a trilaminate of foil, kraft, and foil; a trilaminate of foil, kraft, and polyethylene terephthalate (PET); a coated glass mat; a layer of pure polyethylene terephthalate (PET).

27. The method of claim 14, wherein the facer comprises one or more of the following: foil; kraft; aluminum; glass fiber; glass mat; organic mat; inorganic mat; a coating; an aluminum reflective surface; hard temper foil; a 2-ply laminate of foil and kraft; a trilaminate of foil, kraft, and foil; a trilaminate of foil, kraft, and polyethylene terephthalate (PET); a coated glass mat; a layer of pure polyethylene terephthalate (PET).

28. The method of claim 24, wherein the facer comprises one or more of the following: foil; kraft; aluminum; glass fiber; glass mat; organic mat; inorganic mat; a coating; an aluminum reflective surface; hard temper foil; a 2-ply laminate of foil and kraft; a trilaminate of foil, kraft, and foil; a trilaminate of foil, kraft, and polyethylene terephthalate (PET); a coated glass mat; a layer of pure polyethylene terephthalate (PET).

29. A roof system, comprising:

a roof frame;

a roof diaphragm connected to the roof frame, the roof diaphragm comprising:

a nail board; and an insulating panel bonded to the nail board so that respective surfaces of the insulating panel and the nail board mate against one another, the insulating panel comprising a foam core;

and an attic space at least partially defined by the roof frame and the roof diaphragm;

wherein the roof frame comprises first and second roof structural members;

wherein the insulating panel is positioned between the nail board and each of the first and second roof structural members so that:

first and second portions of the foam core are engaged with the first and second roof structural members, respectively;

a third portion of the foam core extends between the first and second roof structural members;

the third portion of the foam core is exposed to the attic space and is thus visible within the attic space; and the nail board does not engage either the first roof structural member or the second roof structural member.

30. The roof system of claim 29, wherein the insulating panel further includes a facer bonded to a side of the foam core proximate the nail board, the facer defining the surface of the insulating panel that mates against the surface of the nail board.

31. The roof system of claim 30, wherein the facer is a glass fiber reinforced aluminum foil facer, a glass fiber/organic mat facer, or an inorganic polymer coated glass fiber mat facer.

32. The roof system of claim 29, wherein:

the nail board defines a first length and a first width;

the insulating panel defines a second length and a second width;

the first length is less than the second length; and the first width is less than the second width.

33. The roof system of claim 29, wherein:

the roof diaphragm extends at an angle of inclination equal to or greater than 10 degrees from horizontal;

the first and second portions of the foam core are engaged with the first and second roof structural members, respectively, along a plane;

the plane, along which the first and second portions of the foam core engage the first and second roof structural members, respectively, extends at the angle of inclination; and the third portion of the foam extending between the first and second roof structural members and exposed to the attic space extends at the angle of inclination.

34. The roof system of claim 29, further comprising a plurality of roofing fasteners embedded into the insulating panel so that the insulating panel is an only barrier preventing exposure of respective distal ends of the roofing fasteners within the attic space.

35. The roof system of claim 34, further comprising:

a protective layer of sheeting installed over the roof diaphragm; and a roof cover installed over the protective layer of sheeting and the roof diaphragm;

wherein the roofing fasteners extend through the roof cover, the protective layer of sheeting, and the nail board, and into the insulating panel.

36. The roof system of claim 29, further comprising a plurality of nail board fasteners connecting the roof diaphragm to the roof frame, the nail board fasteners each extending through the nail board, through the insulating panel, and into the roof frame;

wherein respective ones of the nail board fasteners extend into the first and second roof structural members.

37. The roof system of claim 36, wherein the insulating panel and the nail board define first and second thicknesses, respectively; and wherein the nail board fasteners and at least the respective first and second thicknesses of the insulating panel and the nail board are sized so that respective depths to which the nail board fasteners penetrate the roof frame are at least 1 inch.

38. The roof system of claim 29, wherein the foam core includes an extruded or expanded polystyrene.

39. The roof system of claim 30, wherein the facer comprises one or more of the following: foil; kraft; aluminum; glass fiber; glass mat; organic mat; inorganic mat; a coating; an aluminum reflective surface; hard temper foil; a 2-ply laminate of foil and kraft; a trilaminate of foil, kraft, and foil; a trilaminate of foil, kraft, and polyethylene terephthalate (PET); a coated glass mat; a layer of pure polyethylene terephthalate (PET).

40. A method of installing a roof system, the method comprising:

positioning a roof diaphragm adjacent a roof frame, the roof diaphragm comprising a nail board and an insulating panel bonded to the nail board so that respective surfaces of the insulating panel and the nail board mate against one another, the insulating panel including a foam core; and connecting the roof diaphragm to the roof frame, the roof diaphragm and the roof frame at least partially defining an attic space;

wherein the roof frame comprises first and second roof structural members;

wherein the insulating panel is positioned between the nail board and each of the first and second roof structural members so that:

first and second portions of the foam core are engaged with the first and second roof structural members, respectively;

a third portion of the foam core extends between the first and second roof structural members;

the third portion of the foam core is exposed to the attic space and is thus visible within the attic space; and the nail board does not engage either the first roof structural member or the second roof structural member.

41. The method of claim 40 further comprising:

before positioning the roof diaphragm adjacent the roof frame, forming the roof diaphragm so that the roof diaphragm comprises the nail board and the insulating panel bonded thereto.

42. The method of claim 40, wherein the insulating panel further includes a facer bonded to a side of the foam core proximate the nail board, the facer defining the surface of the insulating panel that mates against the surface of the nail board.

43. The method of claim 42, wherein the facer is a glass fiber reinforced aluminum foil facer, a glass fiber/organic mat facer, or an inorganic polymer coated glass fiber mat facer.

44. The method of claim 40, wherein:

the nail board defines a first length and a first width;

the insulating panel defines a second length and a second width;

the first length is less than the second length; and the first width is less than the second width.

45. The method of claim 40, wherein positioning the roof diaphragm comprises:

positioning the roof diaphragm adjacent the roof frame so that the roof diaphragm extends at an angle of inclination equal to or greater than 10 degrees from horizontal;

wherein the first and second portions of the foam core are engaged with the first and second roof structural members, respectively, along a plane;

wherein the plane, along which the first and second portions of the foam core engage the first and second roof structural members, respectively, extends at the angle of inclination; and wherein the third portion of the foam extending between the first and second roof structural members and exposed to the attic space extends at the angle of inclination.

46. The method of claim 40, further comprising:

embedding a plurality of roofing fasteners into the insulating panel so that the insulating panel is an only barrier preventing exposure of respective distal ends of the roofing fasteners within the attic space.

47. The method of claim 46, further comprising:

installing a protective layer of sheeting over the roof diaphragm; and installing a roof cover over the protective layer of sheeting and the roof diaphragm;

wherein the roofing fasteners extend through the roof cover, the protective layer of sheeting, and the nail board, and into the insulating panel.

48. The method of claim 40, wherein connecting the roof diaphragm to the roof frame comprises:

driving a plurality of nail board fasteners through the nail board, through the insulating panel, and into the roof frame;

wherein respective ones of the nail board fasteners extend into the first and second roof structural members.

49. The method of claim 48, wherein the insulating panel and the nail board define first and second thicknesses, respectively; and wherein the nail board fasteners and at least the respective first and second thicknesses of the insulating panel and the nail board are sized so that respective depths to which the nail board fasteners penetrate the roof frame are at least 1 inch.

50. The method of claim 40, wherein the foam core includes an extruded or expanded polystyrene.

51. The method of claim 42, wherein the facer comprises one or more of the following: foil; kraft; aluminum; glass fiber; glass mat; organic mat; inorganic mat; a coating; an aluminum reflective surface; hard temper foil; a 2-ply laminate of foil and kraft; a trilaminate of foil, kraft, and foil; a trilaminate of foil, kraft, and polyethylene terephthalate (PET); a coated glass mat; a layer of pure polyethylene terephthalate (PET).

52. A roof system, comprising:

polyethylene terephthalate (PET); a coated glass mat; a layer of pure polyethylene terephthalate (PET).

53. The roof system of claim 52, wherein:

the nail board defines a first length and a first width;

the insulating panel defines a second length and a second width;

the first length is less than the second length; and the first width is less than the second width.

54. The roof system of claim 52, wherein:

the roof diaphragm extends at an angle of inclination equal to or greater than 10 degrees from horizontal;

the facer is engaged with each of the first and second roof structural members along a plane;

the plane along which the facer engages each of the first and second roof structural members extends at the angle of inclination; and the portion of the facer extending between the first and second roof structural members and exposed to the attic space extends at the angle of inclination.

55. The roof system of claim 52, further comprising a plurality of roofing fasteners embedded into the insulating panel so that the insulating panel prevents exposure of respective distal ends of the roofing fasteners within the attic space.

56. The roof system of claim 55, further comprising:

a protective layer of sheeting installed over the roof diaphragm; and a roof cover installed over the protective layer of sheeting and the roof diaphragm;

a roof frame;

a roof diaphragm connected to the roof frame, the roof diaphragm comprising:

a nail board; and an insulating panel bonded to the nail board so that respective surfaces of the insulating panel and the nail board mate against one another, the insulating panel comprising:

a foam core; and a facer bonded to a side of the foam core opposite the nail board;

and an attic space at least partially defined by the roof frame and the roof diaphragm;

wherein the roof frame comprises first and second roof structural members;

wherein the insulating panel is positioned between the nail board and each of the first and second roof structural members so that:

first and second portions of the facer are engaged with the first and second roof structural members, respectively;

a third portion of the facer extends between the first and second roof structural members;

the third portion of the facer is exposed to the attic space and is thus visible within the attic space; and the nail board does not engage either the first roof structural member or the second roof structural member;

and wherein the facer, and thus the third portion of the facer exposed to the attic space and thus visible within the attic space, comprises one or more of the following: foil; kraft; aluminum; glass fiber; glass mat; organic mat; inorganic mat; a coating; an aluminum reflective surface; hard temper foil; a 2-ply laminate of foil and kraft; a trilaminate of foil, kraft, and foil; a trilaminate of foil, kraft, and wherein the roofing fasteners extend through the roof cover, the protective layer of sheeting, and the nail board, and into the insulating panel.

57. The roof system of claim 52, wherein the foam core includes a closed-cell rigid polyisocyanurate.

58. The roof system of claim 52, further comprising a plurality of nail board fasteners connecting the roof diaphragm to the roof frame, the nail board fasteners each extending through the nail board, through the insulating panel, and into the roof frame;

wherein respective ones of the nail board fasteners extend into the first and second roof structural members.

59. The roof system of claim 58, wherein the insulating panel and the nail board define first and second thicknesses, respectively; and wherein the nail board fasteners and at least the respective first and second thicknesses of the insulating panel and the nail board are sized so that respective depths to which the nail board fasteners penetrate the roof frame are at least 1 inch.

60. The roof system of claim 52, wherein the insulating panel further comprises another facer bonded to a side of the foam core proximate the nail board, the another facer defining the surface of the insulating panel that mates against the surface of the nail board.

61. The roof system of claim 60, wherein the another facer is a glass fiber reinforced aluminum foil facer, a glass fiber/organic mat facer, or an inorganic polymer coated glass fiber mat facer.

62. The roof system of claim 60, wherein the another facer comprises one or more of the following: foil; kraft; aluminum; glass fiber; glass mat; organic mat; inorganic mat; a coating; an aluminum reflective surface; hard temper foil; a 2-ply laminate of foil and kraft; a trilaminate of foil, kraft, and foil; a trilaminate of foil, kraft, and polyethylene terephthalate (PET); a coated glass mat; a layer of pure polyethylene terephthalate (PET).

* * * * *